United States Patent [19]

Stobart

[11] Patent Number: 5,052,462

[45] Date of Patent: Oct. 1, 1991

[54] CANVAS TENSIONING PICTURE FRAME

[76] Inventor: John Stobart, Townhouse No. 23, Union Wharf, Boston, Mass. 02109

[21] Appl. No.: 558,598

[22] Filed: Jul. 27, 1990

Related U.S. Application Data

[63] Continuation-in-part of Ser. No. 307,789, Feb. 7, 1989, Pat. No. 4,947,922.

[51] Int. Cl.[5] ..... D06C 3/08

[52] U.S. Cl. ..... 160/374.1; 160/381; 38/102.5

[58] Field of Search ..... 160/374.1, 374, 373, 160/372, 376, 378, 381, 405; 38/102.5, 102.4, 102.6, 102.7, 102.8, 102.9, 102.91

[56] References Cited

U.S. PATENT DOCUMENTS

| | | | |
|---|---|---|---|
| 371,933 | 10/1887 | Gray | 160/374.1 |
| 371,934 | 10/1887 | Gray | 160/374.1 |
| 1,128,362 | 2/1915 | Rawbon | 160/374.1 |
| 2,149,985 | 3/1939 | Tepper | 160/374.1 |
| 3,238,996 | 3/1966 | Munn | 160/374.1 |
| 4,829,685 | 5/1989 | Persson et al. | 160/381 X |
| 4,947,922 | 8/1990 | Stobart | 160/374.1 |

*Primary Examiner*—David M. Purol
*Attorney, Agent, or Firm*—Stetina and Brunda

[57] ABSTRACT

A canvas tensioning picture frame formed by a plurality of adjacent frame members having complementary first and second half-cavities formed in the ends thereof, a complementary half-bore extending between the first and second cavities, a first disk having a central aperture, a second disk having a central aperture, and a frusto-conical screw having a head sized to be received by the central aperture of the first disk. The first disk is disposed within a first cavity formed of the two first half-cavities of adjacent frame members and is manually rotatable therein. The second disk is disposed within a second cavity formed of the two second half-cavities of adjacent frame members and is firmly engaged therein to limit relative movement of adjacent frame members. The frusto-conical screw is turned by rotating the first disk and thus driving the frusto-conical screw downwardly into a bore formed by the two complimentary half-bores of adjacent frame members. This action urges the two adjacent frame members apart, thus increasing the enclosed area of the frame and stretching a canvas attached thereto.

9 Claims, 2 Drawing Sheets

40
38
36
42
44
45
46
60
48
60
62
66
12
34
52
56
64
54
58
50
56
52
18

CANVAS TENSIONING PICTURE FRAME

RELATED APPLICATIONS

This is a continuation-in-part of co-pending application Ser. No. 07/307,789, filed Feb. 7, 1989, now U.S. Pat. No. 4,947,922, the disclosure of which is expressly incorporated herein by reference.

FIELD OF THE INVENTION

The present invention relates generally to picture frames and more particularly to a canvas tensioning picture frame which permits convenient adjustment of the framed area to maintain the desired amount of tension upon a canvas stretched thereover. Proper tensioning prevents sagging of the canvas and distortion of the image formed thereon.

BACKGROUND OF THE INVENTION

Canvasses are frequently stretched over wood frames to provide a medium upon which an artist may render images using oil paint and the like. Over time, the canvas tends to stretch and the wood often tends to shrink, thus reducing the tension of the canvas and permitting it to sag or otherwise become distorted due to wrinkles or depressions formed thereon. As is recognized in the prior art, it is desirable to provide a means for periodically adjusting the tension of the canvas stretched upon a frame. This is typically accomplished by causing adjacent frame members to move apart such that the area enclosed by the frame is increased slightly and consequently the tension of the canvas is likewise increased.

Typically, picture frames are stretched to provide tension to the canvas installed thereupon by driving wedges into the crevices formed between adjacent frame members such that the frame members are forced apart and the area enclosed by the frame is increased. The wedges are inserted from the inside of the frame such that they point toward the outer perimeter of the frame. Such wedges must be tapped into place using a small hammer or mallet and therefore present a hazard to the canvas stretched over the frame. It is possible to inadvertently strike the rear surface of the canvas when attempting to drive the wedges into place. It is also possible to inadvertently drive a wedge through the canvas. Such actions would irreparably damage the canvas and potentially result in the destruction of valuable artwork. The use of such prior art wedges is illustrated in U.S. Pat. No. 1,128,362 issued to Rawbon.

Various alternative mechanisms have also been suggested in the prior art for accomplishing an adjustable tensioning frame. Picture frames having stretcher means for increasing the area of the frame to prevent sagging and distortion of the canvas are well known. One such picture frame is disclosed in U.S. Pat. No. 4,829,685 issued to Persson et al.. The Persson device utilizes first and second eccentric bearing surfaces disposed between adjacent frame members which, when rotated, force the frame members apart. The two bearing surfaces are disposed within cavities or cutouts formed at the interface of the two frame members. The two bearing surfaces cooperate together asymmetrically such that rotation of the two bearing surfaces causes a camming action to force adjacent frame members apart.

A second frame structure utilizing a camming action caused by an eccentric disk is disclosed in U.S. Pat. No. 371,934 issued to Gray. In the Gray device, rotation of an eccentric disk pivotally mounted to one frame member urges the adjacent frame member away. Dowels are used to prevent undesirable rotation of the adjacent frame members. The Gray device utilizes a tool, such as a wrench, to effect rotation of the disk.

Various lever and screw type mechanisms are disclosed in U.S. Pat. Nos. 371,933, 2,149,985, and 3,238,996 issued to Gray, Tepper, and Munn, respectively. The disclosures of Gray, Tepper, and Munn, as well as those of Persson, Gray, and Rawbon provide a broad overview of the various attempts of the prior art to provide means to permit a user to selectively stretch a canvas upon a frame and to periodically make adjustments to the tension of the canvas to compensate for natural stretching of the canvas and/or shrinkage of the frame due to environmental conditions such as humidity and temperature.

Although the prior art has recognized the problem of preventing sagging and distortion of a canvas stretched upon a picture frame, such proposed solutions to date have been ineffective in providing a solution which permits the user to conveniently and safely make such adjustments and which is also inexpensive to manufacture.

SUMMARY OF THE INVENTION

The present invention specifically addresses and alleviates the above mentioned deficiencies associated in the prior art. More particularly, the present invention comprises a canvas tensioning picture frame formed of a plurality of adjacent frame members having complementary first and second half-cavities formed in the ends thereof, a complementary half-bore extending between the first and second cavities, a first disk having a square central aperture, a second disk having a central aperture, and a frusto-conical screw having a head portion sized to be received by the square central aperture of the first disk.

The first disk is disposed within a first cavity formed of the two first half-cavities of adjacent frame members and is manually rotatable therein. The second disk is disposed within a second cavity formed of the two second half-cavities of adjacent frame members and is firmly engaged therein to limit relative movement of the adjacent frame members. The square head of the frusto-conical screw is disposed within the square central aperture of the first disk and the shank of the frusto-conical screw is disposed within a frusto-conical bore formed by the two half-bores of adjacent frame members.

The frusto-conical screw is turned by rotating the first disk. Turning the first disk drives the frusto-conical screw downwardly into the frusto-conical bore formed by the two complimentary half-bores of adjacent frame members. Fingerholds formed in the first disk facilitate easy manual rotation thereof. This downward driving action urges or wedges the two adjacent frame members apart, thus increasing the enclosed area of the frame and stretching a canvas attached thereto.

Thus, the present invention provides a convenient means whereby the user may increase the tension of a canvas stretched over a picture frame by manually rotating the first disk without the aid of any tools. The present invention utilizes inexpensive molded parts and requires only a minor modification of the picture frame. These, as well as other advantages of the present invention will be more apparent from the following description and drawings. It is understood that changes in the specific structure shown and described may be made within the scope of the claims without departing from the spirit of the invention.

DETAILED DESCRIPTION OF THE PREFERRED EMBODIMENT

Figure 5:
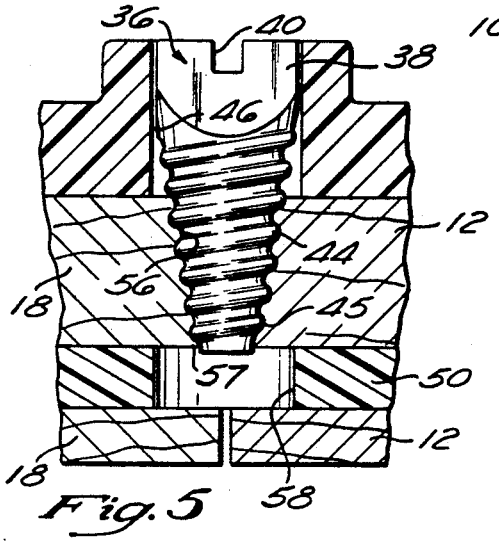
FIG. 5 is an enlarged sectional view of the frusto-conical screw of the present invention as it forces two adjacent frame members apart.
Figure 1:
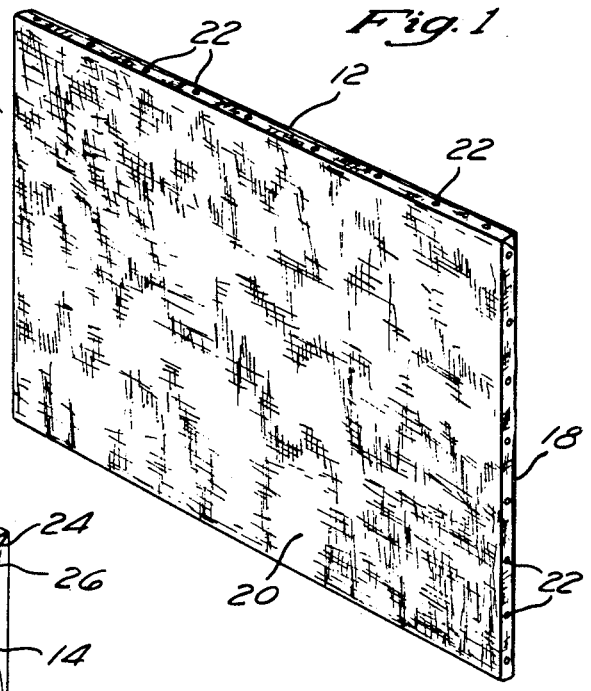
FIG. 1 is a perspective view of the front of a picture frame having canvas attached thereto.
Figure 2:
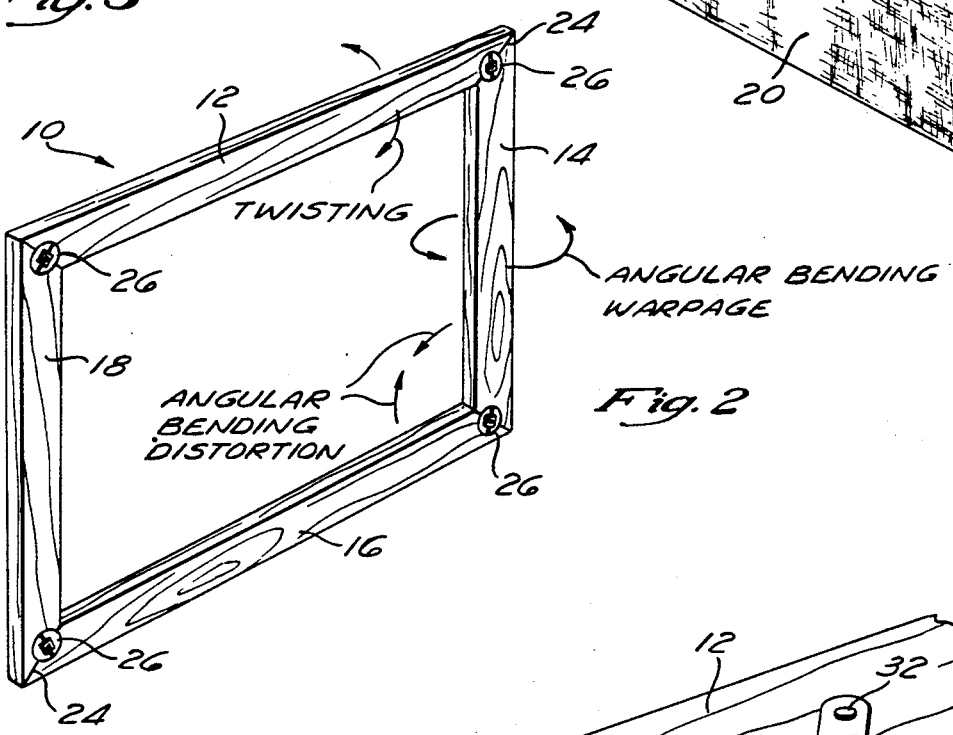
FIG. 2 is a perspective view of the rear of the picture frame of FIG. 1 showing four canvas tensioning devices of the present invention disposed between adjacent frame members and also indicating with arrows various undesirable motions of the frame members.

The detailed description set forth below in connection with the appended drawings is intended as a description of the presently preferred invention, and is not intended to represent the only form in Which the present invention may be constructed or utilized. The description sets forth the instructions and sequence of steps for constructing and operating the invention in connection with the illustrated embodiments. It is to be understood however, that the same or equivalent functions and sequences may be accomplished by different embodiments that are also intended to be encompassed within the spirit and scope of the invention.

The canvas tensioning picture frame of the present invention is generally illustrated in FIGS. 1 through 5. As shown, the canvas tensioning picture frame is generally comprised of four frame members 12, 14, 16, and 18 arranged in a rectangular configuration, a canvas 20, stretched over the frame members 12, 14, 16, and 18, and four canvas tensioning devices 26 disposed at the interface 24 of adjoining frame members 12, 14, 16, and 18. Tacks 22 are typically used to fasten the canvas 20 to the frame members 12, 14, 16, and 18 in a conventional manner.

Figure 3:
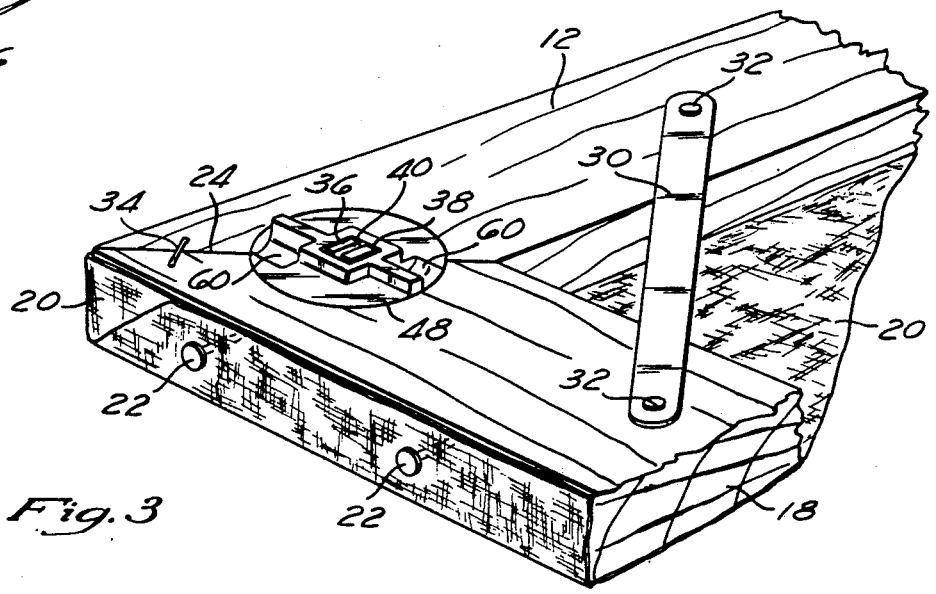
FIG. 3 is an enlarged prospective view of one of the canvas tensioning devices of FIG. 2.
Figure 4:
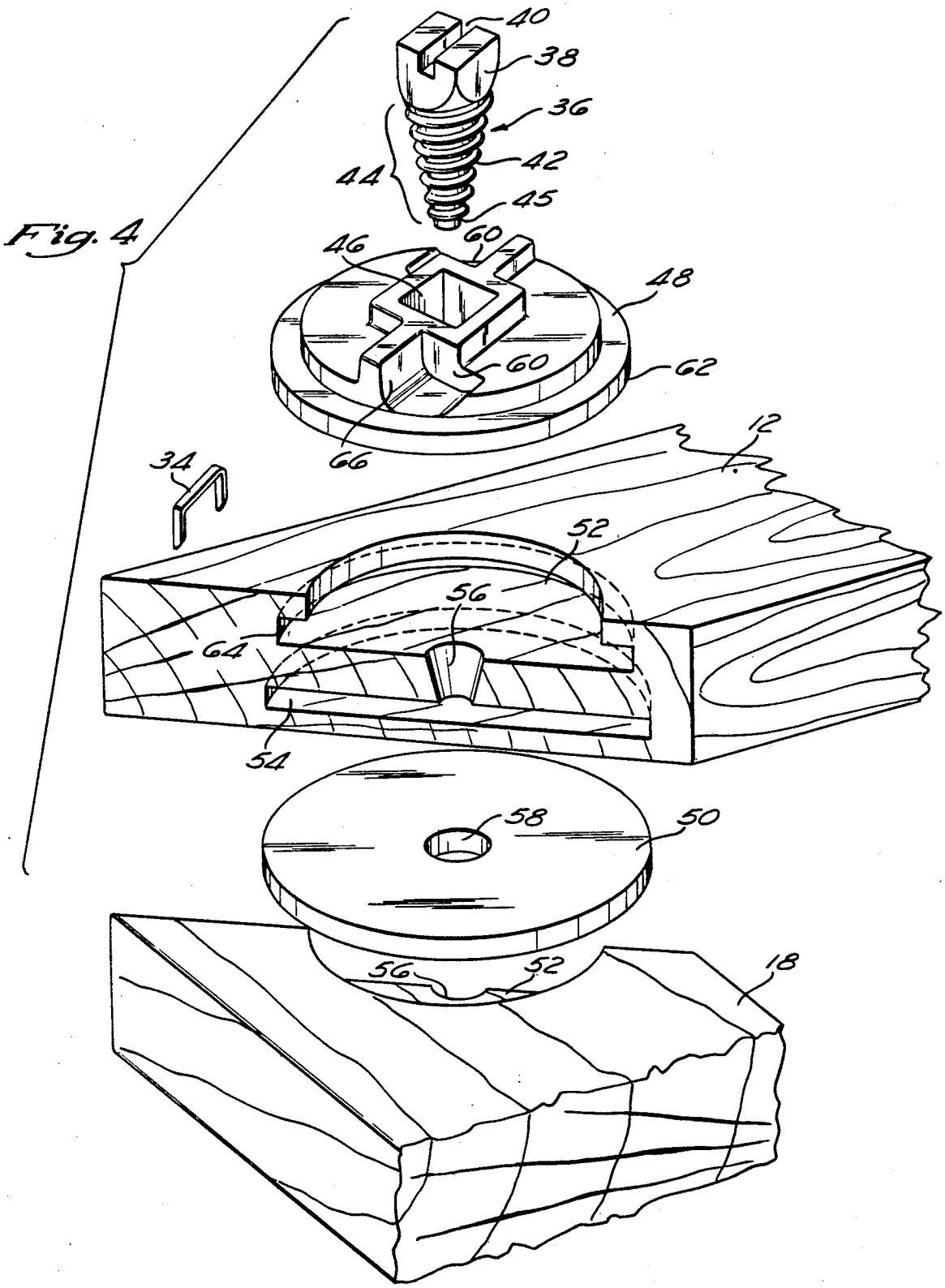
FIG. 4 is a partially exploded perspective view of the canvas tensioning device of FIG. 3.

Referring to FIGS. 3 and 4, each canvas tensioning device 26 is generally comprised of a first disk 48, a second disk 50, a first half-cavity 52, a second half-cavity 54, a half-bore 56, and a frusto-conical screw 36.

A staple 34 provides a convenient means for temporarily securing adjacent frame members 12, 14, 16, and 18 in place prior to attachment of the canvas 22. Metal braces 30 may additionally be attached to frame members 12, 14, 16, and 18 using attachment means such as screws 32 to maintain orthognality during the process of attaching the canvas 20 to the frame members 12, 14, 16, and 18.

The first disk 48 is sized and configured to be received and rotatable within the first cavity formed from two first half-cavities 52 when adjacent frame members 12, 14, 16, and 18 are assembled. Lip 62 of the first disk 48 is captured within groove 64 of the cavity so formed. Thus, the first disk 48 is captured between and inside of adjacent frame members 12, 14, 16, and 18 such that it is free to rotate about its vertical axis. Cutouts 60 formed in the first disk 48 and abutments 66 formed thereon provide a convenient fingerhold means whereby the first disks 48 can be manually turned using finger pressure.

Second disk 50 is specifically sized to firmly engage the second half-cavities 54 formed upon adjacent frame members 12, 14, 16, and 18, thereby preventing undesired relative motion therebetween. The second disk 50 prevents adjacent frame members such as 12 and 18 from rotating relative to each other and also prevents relative vertical translation.

The square head 38 of the frusto-conical screw 36 is sized to be disposed within the square aperture 46 of the first disk 48 and a portion of the shank 44 of the frusto-conical screw 36 is sized to extend into the bore formed by the half-bores 56 of adjacent frame members 12, 14, 16, and 18. The square shape of the head 38 of the frusto-conical screw 36 and the aperture 46 assures that rotation of the first disk 48 causes a simultaneous rotation of the frusto-conical screw 36. A slot 40 is formed in the head 38 of the frusto-conical screw 36. A clockwise rotation of the frusto-conical screw 36 causes the threads 42 of the shank 44 to bite into the sides of half-bores 56. Thus, clockwise rotation of the first disk 48 drives the frusto-conical screw 36 downward into the bore 57. This downward action urges or cams the two adjacent frame members 12, 14, 16, or 18 apart.

The aperture 58 formed in the second disk 50 permits the shank 44 of the frusto-conical screw 36 to extend for a short distance therein. Shank 34 increases in diameter from the tip 45 to the head 38. The hole 58 is sized such that it will permit the shank 44 to extend therein but will limit the amount of extension such that the tip 45 of the frusto-conical screw 36 will not bear against and damage any portion of the frame or canvas. Thus, overtightening of the first disk 48 will not cause the tip 45 of the frusto-conical screw 36 to protrude through the frame and puncture or otherwise damage the canvas 20.

Referring now to FIG. 5, the wedging or camming action of the frusto-conical screw 36 upon adjacent frame members 12 and 18 is depicted. As indicated by the arrows, a clockwise rotation of the frusto-conical screw 36 drives the screw 36 downwardly into bore 57 and therefore urges the two frame members 12 and 18 laterally apart. This wedging action occurs due to the increasing diameter of the shank 44 from its tip 45 to its head 38.

With the structure of the present invention defined, operation of the tensioning picture frame of the present invention may be discussed. Initially the frame is assembled by disposing the first 48 and second 50 disks within their respective cavities 52 and 54 and abutting adjacent frame members such as 12 and 18 to capture the first 48 and second 50 disks therebetween. A staple 34 may then be used to initially secure the components in place for further assembly.

After the four frame members 12, 14, 16, and 18 are thus assembled, the canvas is tacked or stapled to the frame in a conventional manner. A brace 30 may be attached to adjacent frame members 12, 14, 16, and 18 at each corner to maintain the orthognality thereof as the canvas 20 is applied to the frame. Suitable fasteners, such as screws 32, are used to attach the brace 30 to the frame. Next the frusto-conical screw 36 is pressed into the square opening 46 of the first disk 48 while simultaneously rotating the first disk 48 in a clockwise direction such that the frusto-conical screw 36 is driven into the bore 57 formed by the half-bores 56.

The frusto-conical screw 36 should only be driven into the bore by an amount sufficient to securely capture its threads 42 therein. Further clockwise rotation of the first disk 48 should only be performed thereafter as necessary to enlarge the frame and thus stretch the canvas 20 as desired. As will be recognized, during rotation, the frusto-conical screw 36 will form threads within the bore 57 as it is driven therein. Alternatively, the bore 57 can be tapped to accommodate the threads 42 of the frusto-conical screw 36. Cutouts 60 and abutments 66 provide convenient fingerholds for the easy rotation of the first disk 48.

Thereafter, when a periodic inspection of the canvas 20 indicates the need to stretch the picture frame to increase the tension upon the canvas 20, then it is merely necessary to rotate the first disk 48 at each of the corners where such stretching is desired by an amount sufficient to provide the necessary tension. Thus, a simple and convenient means is provided by the present invention for varying the tension of a canvas painting.

A slot 40 formed in the square head 38 of the frusto-conical screws 36 provides a means to rotate a frusto-conical screw in the event that the first disk 48 should fail to do so. This could occur if either the square head 38 or square aperture 46 were to become rounded through wear.

It is understood that the exemplary canvas tensioning picture frame described herein and shown in the drawings represents only a presently preferred embodiment of the invention. Indeed, various modifications and additions may be made to such embodiment without departing from the spirit and scope of the invention. For example, various frame configurations are possible. The present invention does not depend upon the particular frame configuration utilized, but rather upon the structures disclosed to effect the separation of adjacent frame members to increase the enclosed area of the frame. Additionally, the second disk need not be cylindrical or disk shaped, but rather may be of any shape which limits the relative motion of adjacent frame members. Similarly, the mating central aperture of the first disk and screw head may be formed in any non-circular configuration adapted to provide simultaneous rotation of the disk with the screw such as rectangular, triangular, polygonal or the like. Thus, these and other modifications and additions may be obvious to those skilled in the art and may be implemented to adapt the present invention in a variety of different applications.

What is claimed is:

1. A canvas tensioning picture frame comprising:

(a) a plurality of frame members arranged to form a frame over which a canvas may be disposed;

(b) a complimentary first half-cavity formed in the end of at least two of said frame members such that when said frame members are abutted, a first cavity is formed;

(c) a complimentary second half-cavity formed adjacent said first half-cavities such that when said frame members are abutted, a second cavity is formed;

(d) a complimentary half-bore formed intermediate said first half-cavities and said second half-cavities such that when said frame members are abutted, a bore is formed, said bore extending from the first cavity to the second cavity.

(e) a first disk having a central aperture formed therein, said disk rotatably disposed within said first cavity;

(f) a second disk disposed within said second cavity, said second disk firmly engaging said complimentary second half-cavities formed in adjacent frame members to restrict the relative rotation thereof;

(g) a frusto-conical screw slidably disposed within the central aperture of said first disk such that rotation of said first disk causes a like rotation of said frusto-conical screw, the threads of said frusto-conical screw engaging said bore; and (h) wherein rotation of said first disk drives said frusto-conical screw into said bore and operates to move the two adjacent frame members apart.

2. The canvas tensioning picture frame as recited in claim 1 further comprising:

(a) a lip formed about the periphery of said first disk; and (b) a groove formed within said first half-cavities, said groove sized to receive said lip such that said first disk is captured within said first cavity when said frame members are abutted.

3. The canvas tensioning picture frame as recited in claim 2 wherein the central aperture formed in said first disk is square in shape and the head of said screw is correspondingly square in shape.

4. The canvas tensioning picture frame as recited in claim 3 wherein said bore is frusto-conical in shape.

5. The canvas tensioning picture frame as recited in claim 4 wherein said second disk further comprises a central aperture, said central aperture being sized to limit the distance which the shank of said frusto-conical screw can extend therethrough.

6. The canvas tensioning picture frame as recited in claim 5 further comprising at least two abutments formed upon said first disk to facilitate the manual rotation thereof.

7. The canvas tensioning picture frame as recited in claim 6 further comprising cutouts formed in said first disk to facilitate the manual rotation thereof.

8. A method for stretching canvas upon a picture frame comprising the steps of:

(a) forming complimentary first half-cavities in the ends of at least two frame members such that when said frame members are abutted a first cavity is formed;

(b) forming complimentary second half-cavities adjacent said first half-cavities such that when said frame members are abutted, a second cavity is formed;

(c) forming complimentary half-bores intermediate said first half-cavities and said second half-cavities such that when said frame members are abutted, a bore is formed, said bore extending from the first cavity to the second cavity;

(d) abutting at least two frame members such that first and second disks are captured within the first and second cavities thereof, the first disk having a central aperture formed therein;

(e) arranging a plurality of frame members into a desired frame configuration, at least two of said frame members being those with first and second disks captured within first and second cavities thereof;

(f) urging a frusto-conical screw into the central aperture of the first disk;

(g) rotating the first disk to drive the frusto-conical screw into the bore; and (h) wherein driving said frusto-conical screw into said bore operates to move the adjacent frame member apart.

9. The method for stretching canvas upon a picture frame as recited in claim 8 further comprising the steps of:

(a) forming a lip about the periphery of said first disk;

(b) forming a groove within said first half-cavities, said groove sized to receive said lip such that said first disk is captured within said first cavity when said frame members are abutted;

(c) forming at least two abutments upon said first disk to facilitate the manual rotation thereof;

(d) forming at least two cutouts in said first disk to facilitate the manual rotation thereof; and (e) forming a central aperture in said second disk, said central aperture being sized to limit the distance which the shank of said frusto-conical screw can extend therethrough.

* * * * *